US007289087B2

(12) United States Patent
Date

(10) Patent No.: US 7,289,087 B2
(45) Date of Patent: Oct. 30, 2007

(54) CURRENT DRIVER AND DISPLAY DEVICE

(75) Inventor: Yoshito Date, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 683 days.

(21) Appl. No.: 10/817,810

(22) Filed: Apr. 6, 2004

(65) Prior Publication Data

US 2005/0057457 A1 Mar. 17, 2005

(30) Foreign Application Priority Data

Sep. 11, 2003 (JP) ..... 2003-319306

(51) Int. Cl.
*G09G 3/30* (2006.01)

(52) U.S. Cl. ..... 345/76; 345/89; 345/690

(58) Field of Classification Search ..... 345/76, 345/89

See application file for complete search history.

(56) References Cited

U.S. PATENT DOCUMENTS

| | | | | |
|---|---|---|---|---|
| 36,579 | A * | 9/1862 | Pascucci et al. | 238/26 |
| 6,717,878 | B2 * | 4/2004 | Hagura et al. | 365/211 |
| 7,049,991 | B2 * | 5/2006 | Kimura | 341/144 |
| 7,145,379 | B2 * | 12/2006 | Date et al. | 327/431 |
| 2003/0174152 | A1 * | 9/2003 | Noguchi | 345/690 |
| 2003/0184568 | A1 * | 10/2003 | Date et al. | 345/690 |
| 2003/0185031 | A1 * | 10/2003 | Hagura et al. | 365/22 |
| 2005/0110666 | A1 * | 5/2005 | Date | 341/144 |
| 2005/0174306 | A1 * | 8/2005 | Agari et al. | 345/76 |
| 2006/0158362 | A1 * | 7/2006 | Shimizu | 341/144 |

FOREIGN PATENT DOCUMENTS

| | | |
|---|---|---|
| JP | 2000-276108 A | 10/2000 |
| JP | 2003-122289 | 4/2003 |
| JP | 2003-255900 | 9/2003 |
| JP | 2003-323145 | 11/2003 |
| JP | 2004-112183 | 4/2004 |
| WO | WO 2004/054114 A1 | 6/2004 |

OTHER PUBLICATIONS

Japanese Office Action with English translation issued in corresponding Japanese Patent Application No. 2003-319306, dated Mar. 27, 2007.

* cited by examiner

*Primary Examiner*—Amare Mengistu
*Assistant Examiner*—Afroza Y Chowdhury
(74) *Attorney, Agent, or Firm*—McDermott Will & Emery LLP

(57) ABSTRACT

A current driver to which image data including a plurality of grayscale values is input and which outputs an electric current according to the grayscale values of the image data, the current driver comprising: a first input section to which a first reference current is input, a current value of the first reference current being changed according to the grayscale values of the image data; a second input section to which a second reference current is input, the second reference current having a current value different from that of the first reference current; and a current divider circuit which uses the second reference current and the first reference current to output an electric current, the electric current having a value equal to or higher than that of the first reference current and equal to or lower than that of the second reference current.

9 Claims, 14 Drawing Sheets

CURRENT DRIVER AND DISPLAY DEVICE

CROSS-REFERENCE TO RELATED APPLICATION

This nonprovisional application claims priority under 35 U.S.C. § 119(a) on Japanese Patent Application No. 2003-319306, the entire contents of which are hereby incorporated by reference.

BACKGROUND OF THE INVENTION

1. Field of the Invention

The present invention relates to a current driver for supplying a drive current to a display panel, such as an organic EL (Electro Luminescence) display device, or the like.

2. Description of the Prior Art

An organic EL element is an element which itself emits light according to the magnitude of en electric current input to the element. An organic EL display device including organic EL elements over a panel requires no backlight, and accordingly, the thickness thereof can be reduced. Further, the organic EL display device has no limitation on the viewing angle. Thus, the organic EL display device has been an expected next-generation display device which can replace liquid crystal display devices. Among various organic EL display devices, an active organic EL display device, including TFTs (thin film transistors) and organic EL elements which are provided to pixels arranged in a matrix, for example, over a panel on a one-to-one basis, has a response speed superior to that of a passive display device and therefore displays images with high quality.

The organic EL display devices have a driver circuit (current driver) for supplying a drive current to organic EL elements through signal lines and TFTs.

FIG. 12 is a circuit diagram showing part of a conventional organic EL display device disclosed in Japanese Unexamined Patent Publication No. 2000-276108. Among the components of the display device, a display panel 101 and a driver circuit 102 connected to the display panel 101 are shown in FIG. 12.

Pixel circuits provided over the display panel 101 each include a TFT 115 which is connected to a signal line 113 and opens/closes according to selection signal SCAN from a scan line 114, an organic EL element 119 connected to a source of the TFT 115, and a capacitor 117 for storage. One end of the capacitor 117 is connected to the source of the TFT 115, and the supply voltage of the display panel 101 is applied to the other end of the capacitor 117.

The driver circuit 102 includes a data register 108 for taking in image data D0 to D3, a shift register 109 for outputting shift clocks SF1, SF2, . . . each of which indicates the timing of taking image data into the data register 108, a latch circuit 110 for latching the image data taken in the data register 108, and a current mode D/A converter 126 for outputting to the signal line 113 an electric current whose magnitude is determined according to image data D0 to D3. The current mode D/A converter 126 is supplied with supply voltage Vdd. In the example described herein, image data reproduced by one pixel is 4-bit data.

FIG. 13A is a circuit diagram showing a structure of a conventional current mode D/A converter. FIG. 13B illustrates the relationship between image data input to the conventional current mode D/A converter and the electric current output from the D/A converter. In the example of FIG. 13, image data is 6-bit data (D0 to D5), although in the example of FIG. 12 the image data reproduced by one pixel is 4-bit data.

Referring to FIG. 13A, the conventional current mode D/A converter includes an n-channel MISFET 131, a bias line 137 which is connected to the gate electrode and drain of the MISFET 131, current sources $S_0$, $S_1$, . . . and $S_5$ which are formed by n-channel current source MISFETs, and switches $SWg_0$, $SWg_1$, . . . and $SWg_5$ which turn on/off according to image data D0 to D5 to allow/stop the flows of the output currents of the current sources $S_0$, $S_1$, . . . and $S_5$. The drain and gate electrode of the MISFET 131 are connected to each other. During the operation of the D/A converter, a reference current flows through the n-channel MISFET 131. The gate electrodes of the current source MISFETs are commonly connected to the bias line 137. A resistor 135 is provided at an output terminal as necessary.

The current source $S_x$ includes $2^x$ current source MISFETs. That is, the current source $S_0$ includes 1 current source MISFET, the current source $S_1$ includes 2 current source MISFETs, . . . and the current source $S_5$ includes $2^5$ current source MISFETs. The current source MISFETs have the same size and same electric characteristics. The current source MISFETs and the MISFET 131 constitute a current mirror. When the switches $SWg_0$, $SWg_1$, . . . and $SWg_5$ are ON, electric currents of I, 2I, . . . and $\mathbf{2}^5$I are output from the current sources $S_0$, $S_1$, . . . and $S_5$, respectively, where I denotes a unit current. The output currents from the current sources connected to the switches which have been turned on according to image signals are summed and then output from the output terminal to the pixels. In this specification, the "reference current" means an electric current which serves as a source of a current mirror included in a D/A converter. The "unit current" means an output current of the current source MISFET at the least significant bit.

The electric currents flowing through the current source MISFETs are precisely equal due to the current mirror. Thus, as shown in FIG. 13B, in the conventional current mode D/A converter, the input data (grayscale value of image data) and the output current have the relationship of direct proportion.

In the above-described example, the image data is 6-bit data. In the case of n-bit image data (n is a natural number), there are n current sources $S_0$ to $S_{n-1}$, and the current source $S_{n-1}$ includes $2^{n-1}$ current source MISFETs.

In the case of a current mode D/A converter provided in a driver LSI chip, the drain of the MISFET 131 is connected to an external resistor 133 which is provided outside the LSI chip. Alternatively, each of the current sources $S_0$ to $S_5$ may be formed by a single current source MISFET. In this case, the channel widths of the current source MISFETs which constitute the current sources $S_1$, $S_2$, $S_3$, $S_4$ and $S_5$ are 2 W, 4 W, 8 W, 16 W and 32 W, respectively, where W is the channel width of the current source MISFET of the current source $S_0$. However, when transistors have different sizes, a variation in the electric characteristics among the transistors becomes large. Therefore, the accuracy of output currents is higher in the example of FIG. 13.

In a conventional organic EL display device having the above-described structure, display is performed according to image data as described above.

SUMMARY OF THE INVENTION

FIG. 14A illustrates desirable display brightness with respect to the grayscale value of input data. FIG. 14B illustrates the relationship between the grayscale value of input data and the display brightness in a conventional organic EL display device.

In a liquid crystal display device, for example, the relationship between the voltage of input data and the brightness is nonlinear because of the electric characteristics of liquid crystal molecules. Thus, as generally known, it is necessary to correct this nonlinear characteristic (gamma characteristic), and various correction means have been conceived.

In the case of an organic EL element, the emission brightness is substantially proportional to the magnitude of input current. Thus, in an organic EL display device, the display brightness is substantially directly proportional to the grayscale value of input data as shown in FIG. 14B. Further, the organic EL display device is different from the liquid crystal display device in that the panel of the organic EL display device is a current-driven panel. Therefore, conventionally, the organic EL display device have been provided with no gamma correction means.

The present inventors examined the causes of failure to perform display with brightness fidelity to image data and found that the way a human eye perceives the brightness is nonlinear and this is the cause of such failure. That is, the present inventors found that, even when display is performed precisely according to image data, an image observed by a human eye is not as per the image data because the sensitivity characteristic of the viewer's eye to the brightness of light is nonlinear.

The sensitivity of a human eye is relatively high in a low brightness range and a high brightness range but is relatively low in a middle brightness range. Thus, it is desirable that the grayscale value of input data (image data) and the brightness have a relationship represented by a sigmoid shape curve shown in FIG. 14A. Herein, "sigmoid shape" means a shape like the letter S, wherein the gradient is moderate in the low and high brightness ranges but steep in the middle brightness region.

An objective of the present invention is to provide a current-driven display device in which the brightness characteristic with respect to the grayscale value of input data approximates the nonlinear sensitivity of a human eye and a current driver (driver circuit) for use in the current-driven display device.

The first current driver of the present invention is a current driver to which image data including a plurality of grayscale values is input and which outputs an electric current according to the grayscale values of the image data, the current driver comprising a current divider circuit that includes: a first input section to which a first reference current is input, a current value of the first reference current being changed according to the grayscale values of the image data; and a second input section to which a second reference current is input, the second reference current having a current value different from that of the first reference current, wherein the current divider circuit which uses the first reference current and the second reference current to output an electric current, the electric current having a value equal to or higher than that of the second reference current and equal to or lower than that of the first reference current.

With the above structure, a plurality of electric currents can be output using the first reference current and the second reference current. Therefore, for example, in the case where the first and second reference currents are different among the sub-ranges of grayscale values, it is possible to output an electric current according to the grayscale value within the sub-ranges. As a result, it is possible to correct the characteristic of the output current with respect to the grayscale value of the image data so as to conform to the visual characteristics of a human eye. Thus, the image data is reproduced more correctly, for example, brighter parts and darker parts of images are visually perceived more correctly, by using the current driver of the present invention.

The current divider circuit calculates a division value obtained by dividing the difference in the current value between the first reference current and the second reference current into equal parts and outputs electric currents equally separated by the division value according to the grayscale values of the image data. With such a structure, it is possible to modify the output current characteristic so as to approximate the visual characteristics of a human eye.

The first reference current is always larger than the second reference current. Therefore, the output current value is increased as the grayscale value increases. Thus, a display device including the current driver of the present invention performs display based on the image data as intended by the image data. If the second reference current is larger than the first reference current, a negative/positive inverted image is displayed.

The current driver further comprises: a first variable current source for supplying the first reference current to the first input section according to the grayscale values of the image data; and a second variable current source for supplying the second reference current to the second input section according to the grayscale values of the image data. With such a structure, it is possible to correct the output current characteristic so as to approximate the visual characteristics of a human eye. In addition, it is possible to arbitrarily correct the output current value as necessary.

The first variable current source includes a plurality of first switches for respectively conducting a plurality of candidate reference currents, the first switches being commonly connected to the first input section, and a first current selection circuit for controlling the first switches to select any one of the plurality of candidate reference currents as the first reference current. The second variable current source includes a plurality of second switches for respectively conducting the plurality of candidate reference currents, the second switches being commonly connected to the second input section, and a second current selection circuit for controlling the second switches to select any one of the plurality of candidate reference currents as the second reference current. With such a structure, the size of the first and second switches is smaller than that of the MISFETs included in the current divider circuit. In addition, the circuit area of the current divider circuit is much smaller than that of a conventional D/A converter. Thus, the entire circuit area of the current driver of the present invention is much smaller than that of a conventional current driver.

The current divider circuit may be a D/A converter.

The current divider circuit includes: a first current input MISFET of first conductivity type which is connected to the first variable current source, the gate electrode and drain of the first current input MISFET being connected to each other; a first current distribution MISFET of first conductivity type, the first current distribution MISFET and the first current input MISFET constituting a current mirror; a second current input MISFET of first conductivity type which is connected to the second variable current source, the gate electrode and drain of the second current input MISFET being connected to each other; a second current distribution MISFET of first conductivity type, the second current distribution MISFET and the second current input MISFET constituting a current mirror; a third current input MISFET of second conductivity type which is connected to the drain of the second current distribution MISFET, the gate electrode and drain of the third current input MISFET being connected to each other; a fourth current input MISFET of second conductivity type which is connected to the drain of the first current distribution MISFET, the gate electrode and drain of the fourth current input MISFET being connected to each other; a first MISFET having a drain which is connected to the drain of the first current distribution MISFET and a source of the fourth current input MISFET, the first MISFET and the third current input MISFET constituting a current mirror having a mirror ratio of 1; a plurality of current source MISFETs, the current source MISFETs and the fourth current input MISFET constituting current mirrors, the mirror ratio of each current source MISFET to the fourth current input MISFET being 1/m where in is a natural number equal to or greater than 2. With such a structure, the difference between the first reference current and the second reference current is divided into equal parts with high accuracy using a current mirror. Thus, when a current driver including the above current divider circuit is used in a display device, it is possible to increase the brightness according to the increase of the grayscale value, for example. Further, a large difference in the brightness is prevented from being caused at the grayscale value at the boundaries between the sub-ranges of grayscale values. It should be noted that, with the above structure, the number of transistors is significantly decreased as compared with a conventional current driver, and accordingly, the circuit area is smaller than that of the conventional current driver. Therefore, the size of the current source MISFETs is increased, and a variation among output currents is reduced.

The grayscale values of the image data are included in any of a low grayscale range, a middle grayscale range, and a high grayscale range. The difference in the current value between the first reference current and the second reference current which is obtained when the grayscale value of the image data is in the low grayscale range or the high grayscale range is smaller than the difference in the current value between the first reference current and the second reference current which is obtained when the grayscale value of the image data is in the middle grayscale range. With such a structure, the output current is specifically corrected according to the visual characteristics of a human eye. Therefore, a user visually perceives images more correctly.

The current driver includes a plurality of current divider circuits which are in the form of an integrated circuit. A current driver including such a current divider circuit is preferable because it is usable in a small-sized display device.

The second current driver of the present invention is a current driver to which image data including a plurality of grayscale values is input and which outputs an electric current according to the grayscale values of the image data, the current driver comprising: a variable voltage source for outputting a voltage which varies according to the grayscale values of the image data; and a voltage-current conversion circuit for converting an output voltage of the variable voltage source to an electric current.

With the above structure, it is possible to arbitrarily set the output current characteristic using the voltage which is determined according to the grayscale value of the image data. For example, gamma correction is performed to display images as intended by the image data. It should be noted that the variable voltage source is readily designed because the components used in a voltage-driven driver are used in the variable voltage source.

The variable voltage source includes: a plurality of voltage supplying sections for generating different voltages; and a voltage selection circuit for controlling the switches according to the grayscale values of the image data such that an output voltage from any one of the plurality of voltage supplying sections is applied to the voltage-current conversion circuit. With such a structure, the variable voltage source can be formed with a relatively simple design. Thus, the circuit area is smaller than that of a conventional current driver.

The current driver further comprises a plurality of resistive elements which are connected in series between a supply voltage supplying section and a ground, wherein each of the plurality of voltage supplying sections is a node between adjoining resistive elements of the plurality of resistive elements. With such a structure, it is possible to readily correct the output current by arbitrarily setting the resistance values of the resistive elements. In the case where the number of the resistive elements is equal to the number of outputs plus 1, the output current can be corrected for each grayscale value. Thus, display can be performed with more accuracy.

The first display device of the present invention is a display device for displaying image data which includes a current driver for outputting an electric current according to grayscale values of the image data, the current driver including a current divider circuit that includes: a first input section to which a first reference current is input, the current value of the first reference current being varied according to the grayscale values of the image data; and a second input section to which a second reference current is input, the second reference current having a current value different from that of the first reference current, wherein the current divider circuit which uses the first reference current and the second reference current to output a plurality of electric currents, the plurality of electric currents having values equal to or higher than that of the second reference current and equal to or lower than that of the first reference current.

With the above structure, a plurality of electric currents can be output using the first reference current and the second reference current. Therefore, for example, in the case where the first and second reference currents are different among the sub-ranges of grayscale values, it is possible to output an electric current according to the grayscale value within the sub-ranges. As a result, it is possible to correct the brightness characteristic of a panel so as to conform to the visual characteristics of a human eye. Thus, images are displayed with high fidelity to the image data.

The second display device of the present invention is a display device for displaying image data which includes a current driver for outputting an electric current according to grayscale values of the image data, the current driver including: a variable voltage source for outputting an output voltage which varies according to the grayscale values of the image data; and a voltage-current conversion circuit for converting an output voltage of the variable voltage source to an electric current.

With the above structure, it is possible to arbitrarily set the output current characteristic using the voltage corresponding to the grayscale value of the image data. For example, in a current driver, the gradient of a graph which represents the relationship between the output current and the grayscale value of the image data is set smaller in the low and high grayscale ranges rather than in the middle grayscale range, whereby the resolution of the display device is increased in the low and high brightness ranges rather than in the middle brightness range. As a result, it is possible to correct the display characteristics so as to conform to the visual characteristics of a human eye. Thus, images are visually perceived as intended by the image data.

DESCRIPTION OF THE PREFERRED EMBODIMENTS

The present inventors conceived the idea of correcting the display brightness characteristic with respect to input data by changing the structure of a driver circuit (current driver). Specifically, the present inventors conceived the idea of changing the structure of a D/A converter, i.e., a component of the driver circuit from which a drive current is output.

Embodiment 1

Figure 1A:
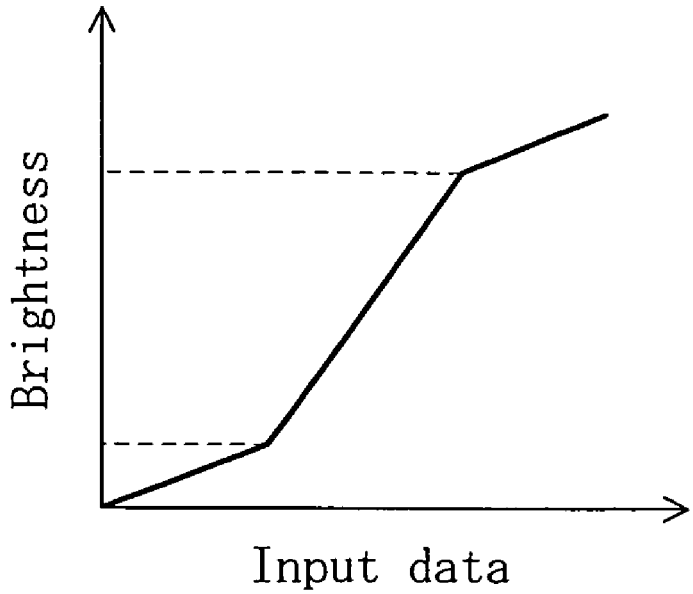
FIG. 1A illustrates the relationship between the grayscale value of input data and the display brightness in an organic EL display device according to embodiment 1 of the present invention.
Figure 1B:
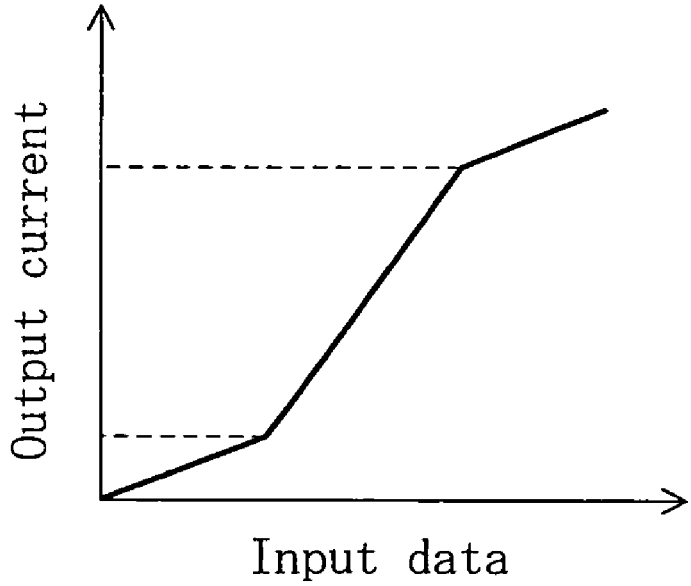
FIG. 1B illustrates the relationship between the grayscale value of input data and the output current in a current driver according to embodiment 1 of the present invention.

FIG. 1A illustrates the relationship between the grayscale value of input data and the display brightness in an organic EL display device according to embodiment 1 of the present invention. FIG. 1B illustrates the relationship between the grayscale value of input data and the output current in a current driver according to embodiment 1.

In the example shown in FIG. 1A, the display brightness of the organic EL display device is divided into three brightness ranges according to the grayscale value of input data (image data). The gradient of the graph which represents the relationship between the brightness and the grayscale vale of input data is different among the brightness ranges. In the example shown in FIG. 1A, we refer to the low brightness range, the middle brightness range and the high brightness range as the first range, the second range and the third range, respectively. The gradient of the graph is steeper in the second range than in the first and third ranges.

In the organic EL display device of embodiment 1, the display characteristic is adjusted so as to approximate the nonlinear characteristic of a human eye which is represented by a sigmoid curve. Thus, a viewer perceives an image as intended by image data.

Figure 14A:
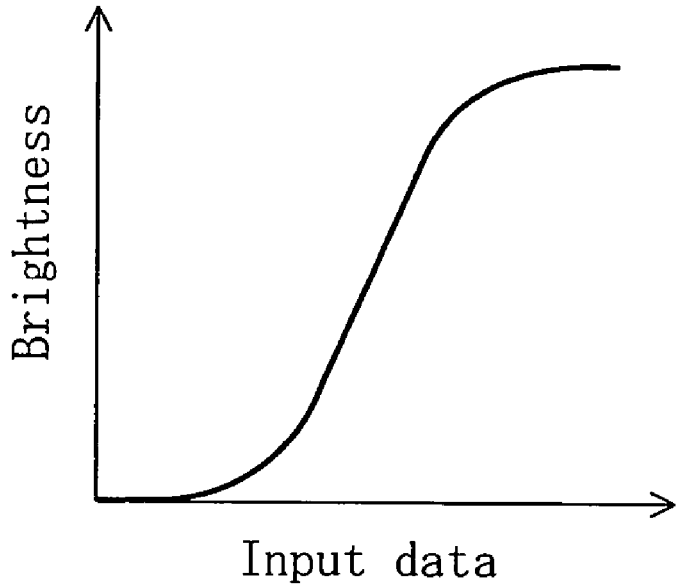
FIG. 14A illustrates desirable display brightness for the grayscale value of input data.
Figure 14B:
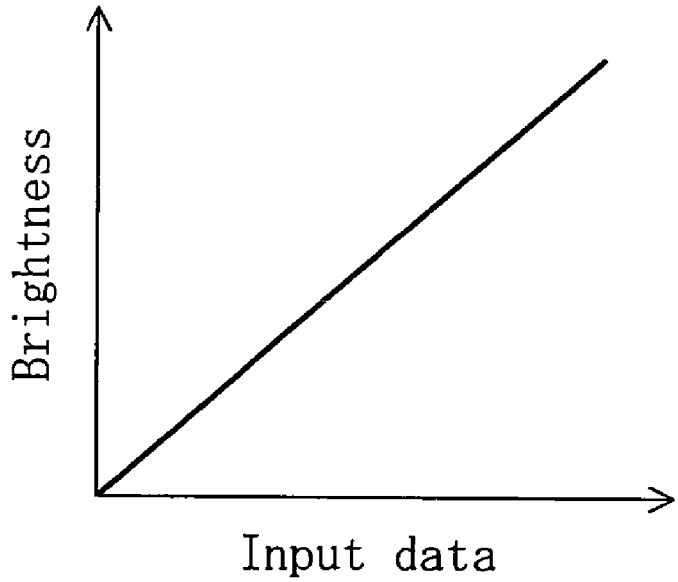
FIG. 14B illustrates the relationship between the grayscale value of input data and the display brightness in a conventional organic EL display device.

In FIG. 1A, the grayscale values are divided into three brightness ranges but may be divided into four brightness ranges so long as the display characteristic approximates the visual characteristic curve of FIG. 14A. As a matter of course, the number of brightness ranges is smaller than the number of grayscale levels.

In order to achieved a display device having the above brightness characteristic, in a current driver of embodiment 1, the graph of the output current against the grayscale value of input data is also divided into three ranges as shown in FIG. 1B. In an organic EL element, the brightness is directly proportional to the magnitude of an electric current input to the organic EL element. Thus, the graph shown in FIG. 1B is a line graph substantially the same as that of FIG. 1A.

Next, a general structure of the current driver for correcting the display characteristic of a current-driven display device as described above is described.

General Structure of a Current Driver of Embodiment 1

The current driver of embodiment 1 is used as a driver circuit of a current-driven display device, such as an organic EL display device, a LED display device, or the like, and is supplied in the form of a LSI circuit in many cases.

Figure 12:
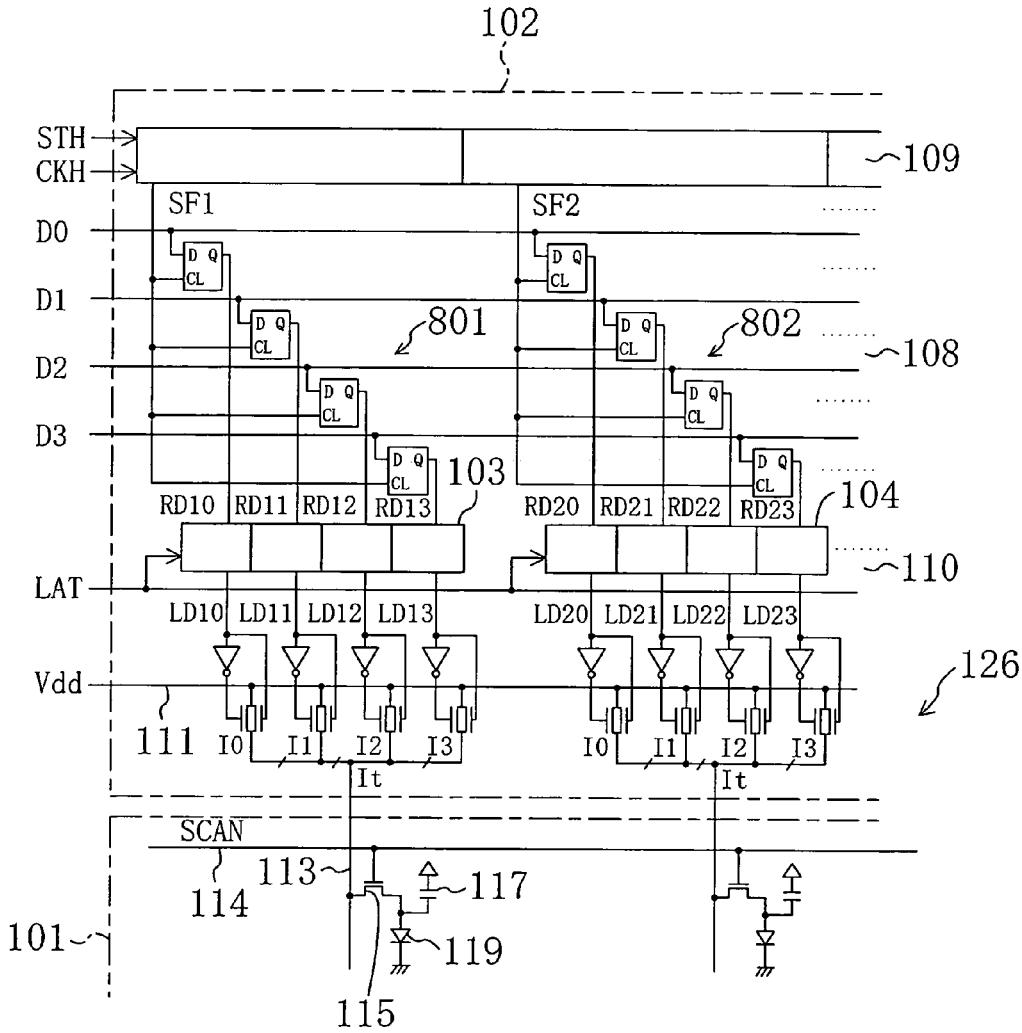
FIG. 12 is a circuit diagram showing part of a conventional organic EL display device.

The current-driven display device of embodiment 1 is the same as the conventional driver circuit 102 shown in FIG. 12 except for the D/A converter. That is, the current driver of embodiment 1 includes a data register for taking in k-bit image data D0 to D(k−1), a shift register for outputting a shift clock which indicates the timing of taking in image data into the data register for each signal line, a latch circuit for latching the image data taken in the data register, and a current mode D/A converter for outputting to a signal line an electric current having the magnitude determined according to the image data D0 to D(k−1). Herein, k is a natural number equal to or greater than 2. The current mode D/A converter is supplied with supply voltage Vdd. It should be noted that a single LSI chip has a length of 10 to 20 mm and 528 output terminals. A feature of the current driver of embodiment 1 resides in the D/A converter as described below.

Figure 2:
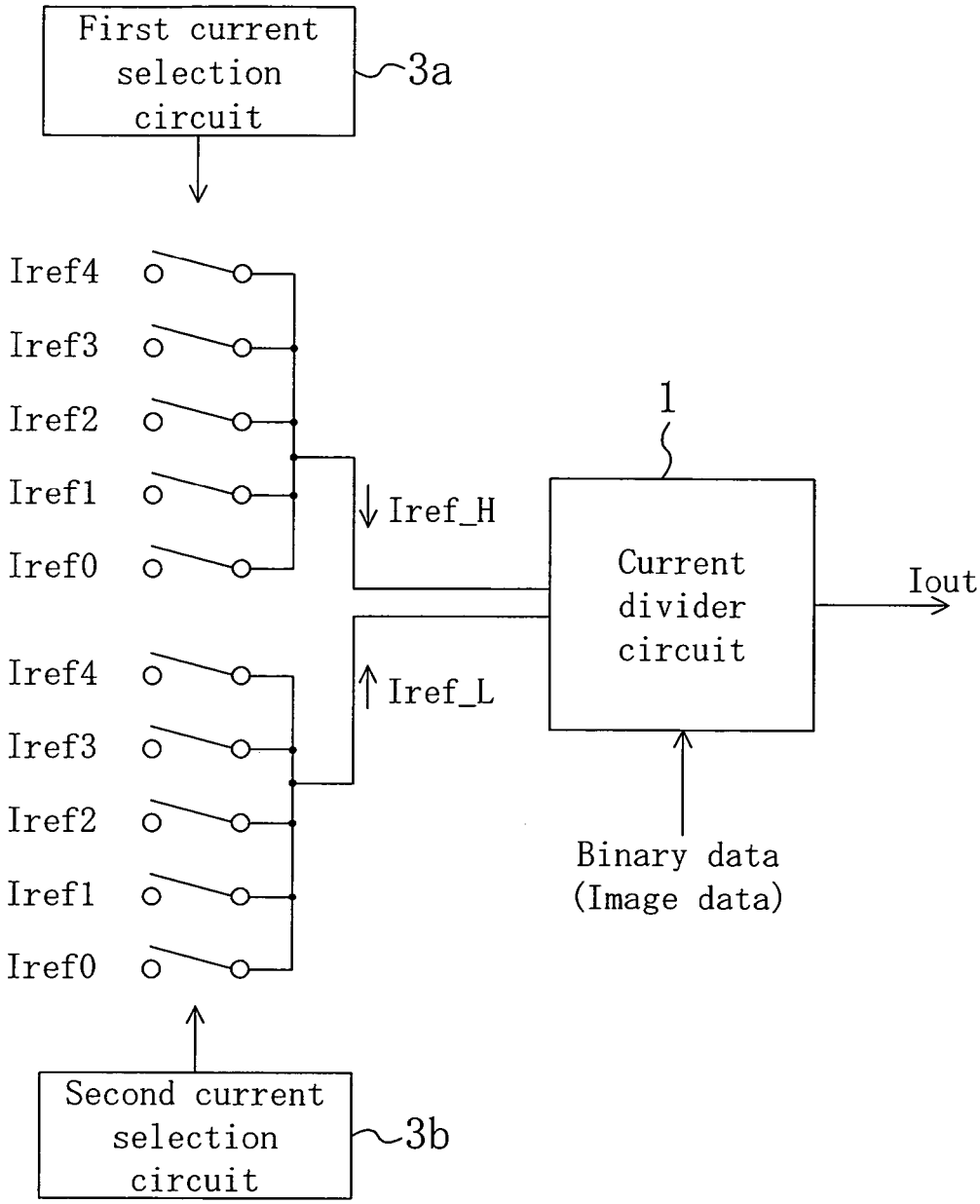
FIG. 2 is a block diagram showing a D/A converter in the current driver of embodiment 1.

FIG. 2 is a block diagram showing a D/A converter in the current driver of embodiment 1.

As shown in FIG. 2, in the current driver of embodiment 1, the D/A converter includes a current divider circuit 1. The current divider circuit 1 receives two variable electric currents, first reference current Iref_H and second reference current Iref_L, and outputs current Iout to a signal line.

The current driver includes a first current selection circuit 3*a* and a second current selection circuit 3*b*. The first current selection circuit 3*a* selects one of candidate reference currents Iref0 to Iref4 and outputs the selected current as first reference current Iref_H. The second current selection circuit 3*b* selects one of candidate reference currents Iref0 to Iref4 and outputs the selected current as second reference current Iref_L. The first current selection circuit 3*a* and second current selection circuit 3*b* are provided in the same chip in which the current divider circuit 1 is also provided. It should be noted that the candidate reference currents are constant currents supplied from the outside of the current divider circuit 1.

In the example illustrated in FIG. 2, a first input section and a second input section of the current divider circuit 1 are each connected to candidate reference currents Iref0 to Iref4 through switches. According to the grayscale value of image data, any one of candidate reference currents Iref0 to Iref4 is selected as first reference current Iref_H, and any one of candidate reference currents Iref0 to Iref4 is selected as second reference current Iref_L. The selected currents are input to the current divider circuit 1. The first current selection circuit 3*a* and second current selection circuit 3*b* control the on/off state of the switches such that the relationship of (Iref_H)>(Iref_L) is always satisfied.

First reference current Iref_H and second reference current Iref_L correspond to the electric currents at both ends of each sub-range of grayscale values. Herein, the sub-ranges of grayscale values means ranges obtained by further dividing each of the ranges of FIG. 1B. For example, in a display device of 64 grayscale levels, if the grayscale values of input data are divided into 16 sub-ranges, each sub-range includes 4 grayscale values corresponding to equally-separated current values. A specific circuit structure of this case will be described later.

The current divider circuit 1 divides the difference between first reference current Iref_H and second reference current Iref_L into m equal parts. In a range from Iref_L to Iref_H, the electric current at m levels which are equally separated by (Iref_H-Iref_L)/m can be output. Herein, m is a natural number equal to or greater than 2.

For example, when m=4, the electric current output from the current divider circuit 1 can be at the following levels (from the lower level):

$I_0$=Iref_L;

$I_1$=Iref_L+(Iref_H−Iref_L)/4;

$I_2$=Iref_L+2(Iref_H−Iref_L)/4; and $I_3$=Iref_L+3(Iref_H−Iref_L)/4.

Since the current divider circuit 1 can divide the difference between two arbitrarily selected electric currents, the output current characteristic can be modified so as to approximate the sigmoid-shaped visual characteristic shown in FIG. 14A by appropriately selecting the values of Iref_H and Iref_L for each sub-range. It should be noted that one current divider circuit 1 is provided to each output of the current driver.

It is only necessary to provide n/m levels of candidate reference currents where n is the number of grayscale levels, although in the above description Iref_H and Iref_L are selected from among candidate reference currents Iref0 to Iref4.

Specific Structure of Current Driver of Embodiment 1

Next, a specific circuit structure of the current driver of embodiment 1 is described wherein the output is a 64-grayscale level output.

Figure 3:
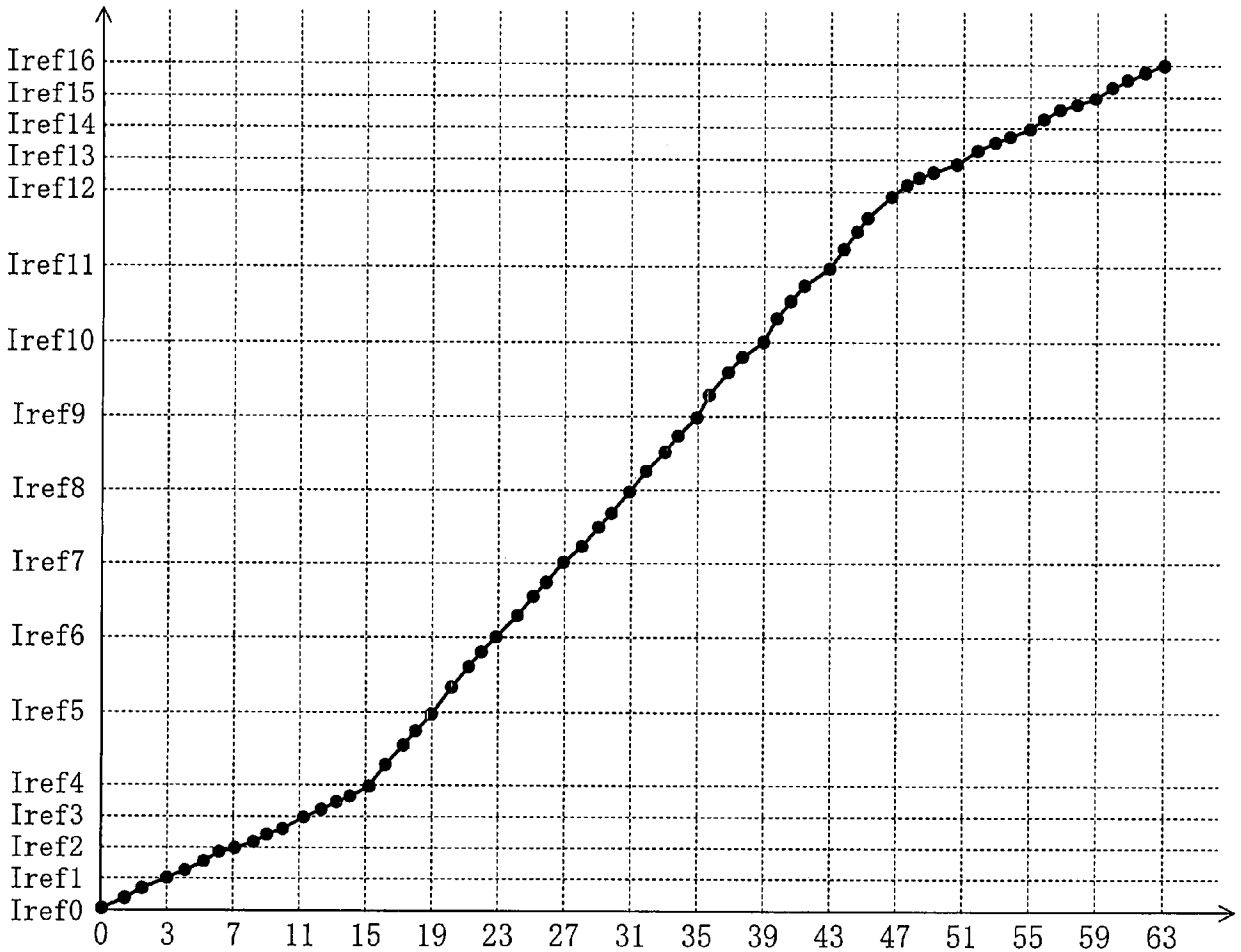
FIG. 3 illustrates the relationship between the grayscale levels and the output current in the current driver of embodiment 1, wherein 64 grayscale levels are divided into 16 sub-ranges.
Figure 4:
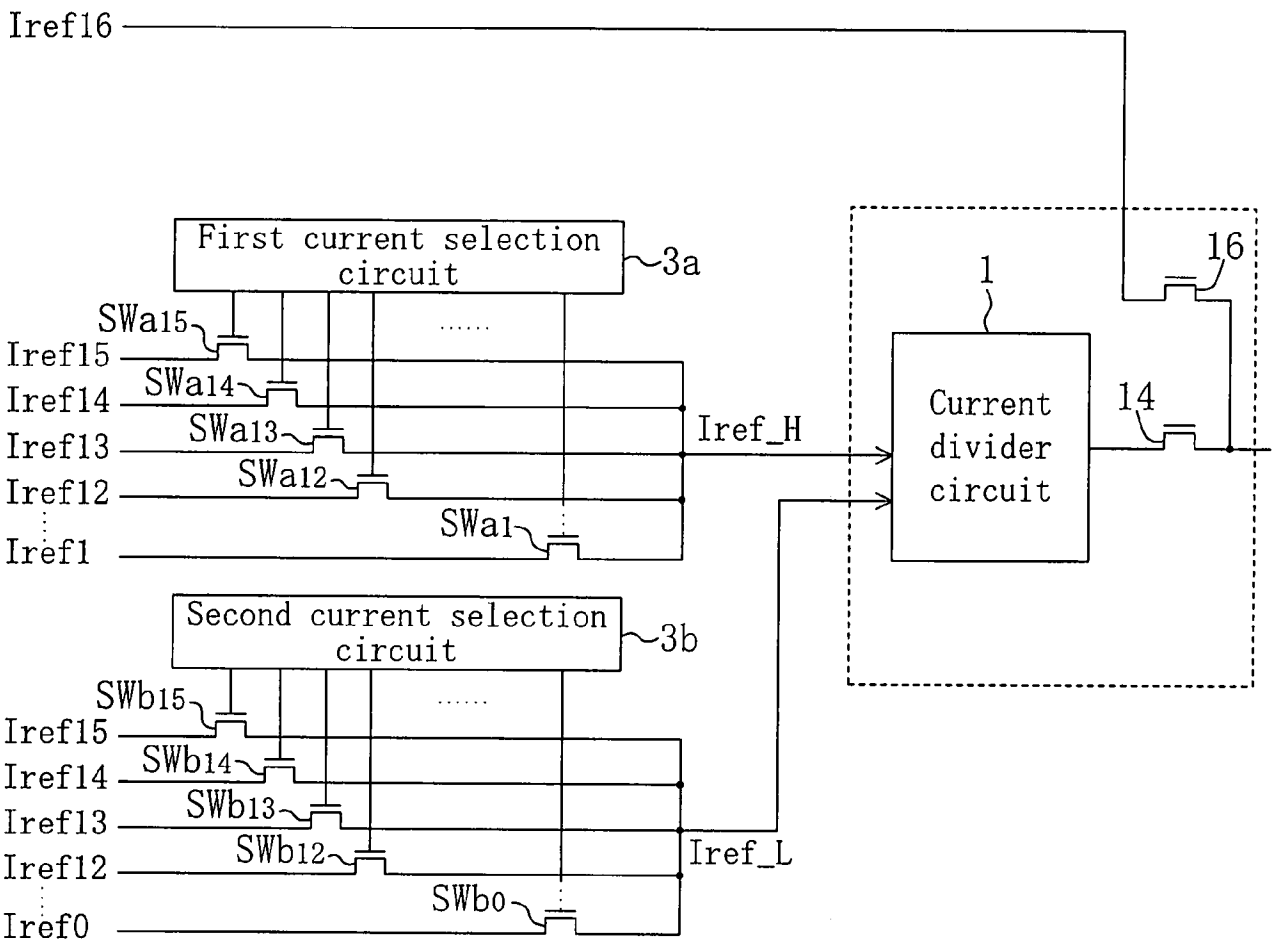
FIG. 4 is a block diagram showing a specific example of a current driver according to embodiment 1.

FIG. 3 illustrates the relationship between the grayscale level and the output current wherein 64 grayscale levels are divided into 16 sub-ranges. FIG. 4 is a block circuit diagram showing a specific example of the current driver of embodiment 1.

In the graph of FIG. 3, the gradient is small (moderate) in the range of 0 to 15 grayscale levels (first range; low grayscale range) and the range of 47 to 63 grayscale levels (third range; high grayscale range) but is large (steep) in the range of 15 to 47 grayscale levels (second range; middle grayscale range). With such an electric output characteristic, the resolution of the display device in the low and high grayscale ranges is higher than that in the middle grayscale range. Thus, display of images is performed so as to conform to the nonlinear visual characteristic of a human eye.

Now, an example of a circuit structure of a current driver having the above output characteristic is described.

The current driver of embodiment 1 shown in FIG. 4 includes: the current divider circuit 1 which receives first reference current Iref_H and second reference current Iref_L at the input section; switch transistors $SWa_1$, $SWa_2$, . . . and $SWa_{15}$ for respectively allowing candidate reference currents Iref1, Iref2, . . . and Iref15, which are supplied from the outside of the LSI chip, to be input to the input section of the current divider circuit 1; the first current selection circuit 3*a* for turning on any one of the switch transistors $SWa_1$, $SWa_2$, . . . and $SWa_{15}$ according to image data to output a candidate reference current corresponding to the selected switch transistor (Iref1, Iref2, . . . or Iref15) as first reference current Iref_H; switch transistors $SWb_0$, $SWb_1$, . . . and $SWb_{15}$ for respectively allowing candidate reference currents Iref0, Iref1, . . . and Iref15 to be input to the input section of the current divider circuit 1; the second current selection circuit 3*b* for turning on any one of the switch transistors $SWb_0$ to $SWb_{15}$ according to image data to output a candidate reference current corresponding to the selected switch transistor (Iref0, Iref1, . . . or Iref15) as second reference current Iref_L; a first output transistor 14 which is connected to the output terminal of the current divider circuit 1; and a second output transistor 16 for outputting candidate reference current Irefl6.

In the case where the grayscale value of image data is in the range of 0 to 62, the first output transistor 14 is ON while the second output transistor 16 is OFF, so that the output of the current divider circuit 1 is employed as the output of the current driver. In the case where the grayscale value of image data is 63, the first output transistor 14 is OFF while the second output transistor 16 is ON, so that candidate reference current Irefl6 is employed as the output of the current driver.

Candidate reference currents Iref0 to Iref16 are readily generated using, for example, a large number of division resistors which are connected in series to the power supply.

Next, the circuit structure of the current divider circuit 1 is described. In embodiment 1, the operation of the current divider circuit 1 is different according to the grayscale value of image data, i.e., different among the case where the grayscale value of image data is in the range of 0 to 2, the case where the grayscale value of image data is in the range of 3 to 62, and the case where the grayscale value of image data is 63. The following descriptions of embodiment 1 are provided respectively for these different operation modes.

Figure 5:
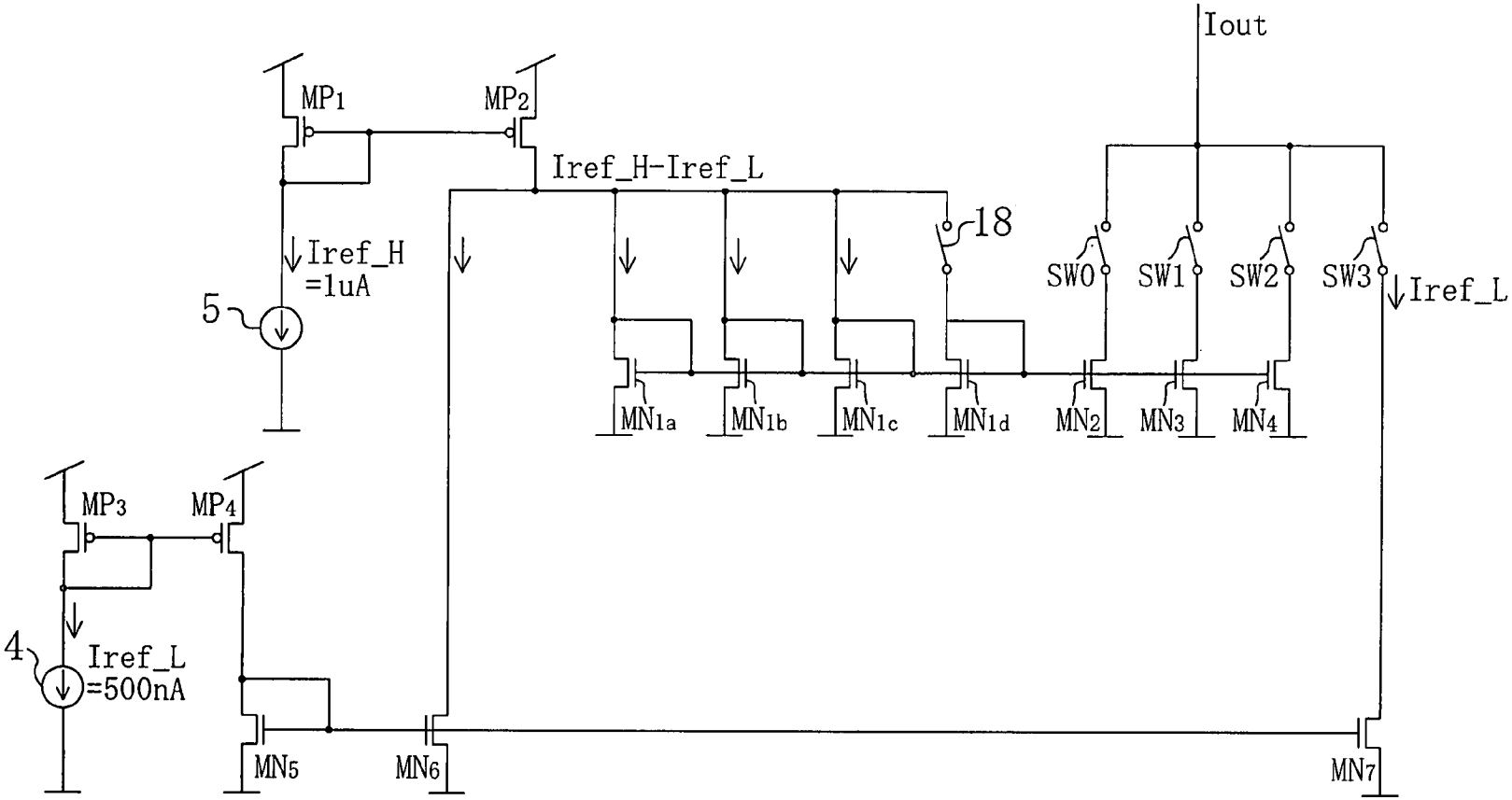
FIG. 5 is a circuit diagram showing a current divider circuit in the current driver of embodiment 1, wherein the grayscale value of image data is in the range of 0 to 2.
Figure 6:
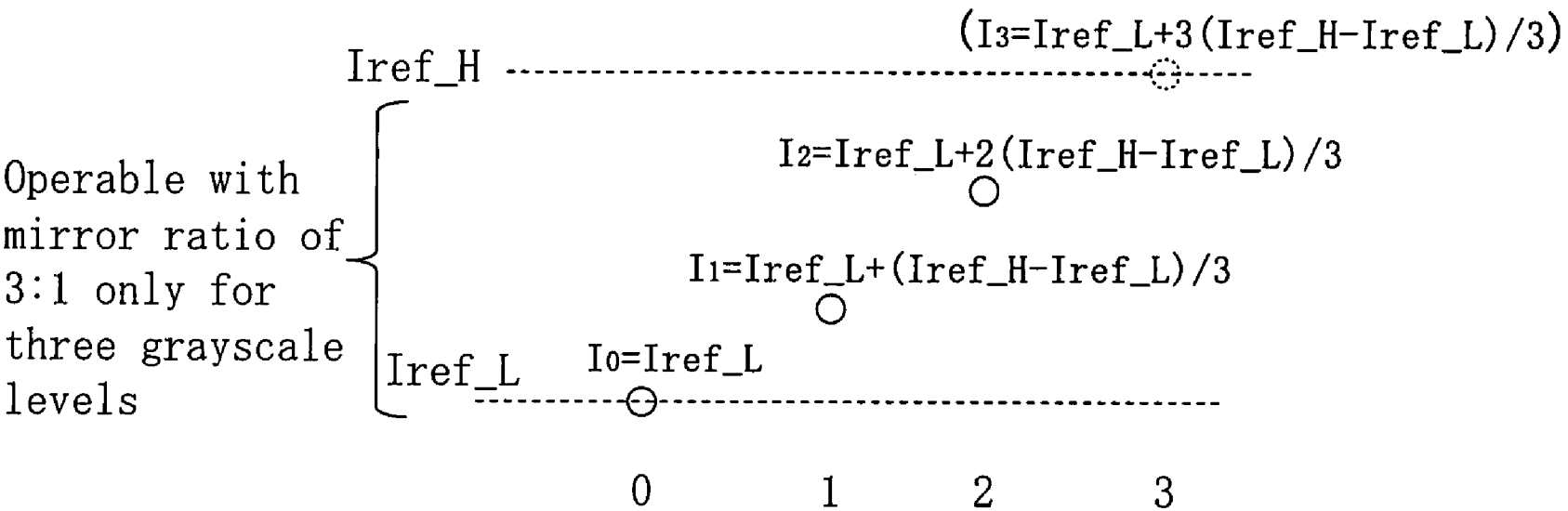
FIG. 6 illustrates an output current from the current divider circuit shown in FIG. 5.

FIG. 5 is a circuit diagram showing a current divider circuit in the current driver of embodiment 1 wherein the grayscale value of image data is in the range of 0 to 2. FIG. 6 illustrates an output current from the current divider circuit shown in FIG. 5.

As shown in FIG. 5, the current divider circuit 1 of embodiment 1 includes: first current input MISFET_$MP_1$ of p-channel type which is connected to a first variable current source 5 for allowing first reference current Iref_H to flow; first current distribution MISFET_$MP_2$ of p-channel type; second current input MISFET_$MP_3$ of p-channel type which is connected to a second variable current source 4 for allowing second reference current Iref_L to flow; second current distribution MISFET_$MP_4$ of p-channel type; third current input MISFET_$MN_5$ of n-channel type which is connected to the drain of second current distribution MISFET_$MP_4$; fourth current input MISFETs_$MN_{1a}$, $MN_{1b}$, $MN_{1c}$, $MN_{1d}$ of n-channel type which are connected in parallel to the drain of first current distribution MISFET_$MP_2$; a switch 18 which is provided between fourth current input MISFET_$MN_{1d}$ and first current distribution MISFET_$MP_2$; first current source MISFET_$MN_2$, second current source MISFET_$MN_3$ and third current source MISFET_$MN_4$ which have the same size ratio; first MISFET_$MN_6$ of n-channel type which has a drain commonly connected to the drain of first current distribution MISFET_$MP_2$ and the source of fourth current input MISFET_$MN_{1d}$; second MISFET_$MN_7$ of n-channel type; and switches $SW_0$, $SW_1$, $SW_2$ and $SW_3$ which are connected to the drains of first current source MISFET_$MN_2$, second current source MISFET_$MN_3$, third current source MISFET_$MN_4$, and second MISFET_$MN_7$, respectively. The gate electrode and drain of first current input MISFET_$MP_1$ are connected to each other. First current input MISFET_$MP_1$ and first current distribution MISFET_$MP_2$ constitute a current mirror. The gate electrode and drain of second current input MISFET_$MP_3$ are connected to each other. Second current input MISFET_$MP_3$ and second current distribution MISFET_$MP_4$ constitute a current mirror. The gate electrode and drain of third current input MISFET_$MN_5$ are connected to each other. The gate electrode and drain of each of fourth current input MISFETs_$MN_{1a}$, $MN_{1b}$, $MN_{1c}$, $MN_{1d}$ are connected to each other. First current source MISFET_$MN_2$, second current source MISFET_$MN_3$ and third current source MISFET_$MN_4$ and fourth current input MISFETs_$MN_{1a}$, $MN_{1b}$, $MN_{1c}$, $MN_{1d}$ constitute a current mirror. First MISFET_$MN_6$ constitutes a current mirror having the same current mirror ratio (mirror ratio of 1) as that of third current input MISFET_$MN_5$. Second MISFET_$MN_7$ constitutes a current mirror having the same current mirror ratio (mirror ratio of 1) as that of first MISFET_$MN_6$.

The fourth current input MISFETs_$MN_{1a}$, $MN_{1b}$, $MN_{1c}$, and $MN_{1d}$ constitute current mirrors having an equal mirror ratio. When the switch 18 is ON (see FIG. 7), the fourth current input MISFETs_$MN_{1a}$ $MN_{1b}$, $MN_{1c}$, $MN_{1d}$ integrally function as a current mirror having a mirror ratio of 4 with respect to the current source MISFETs which include the first current source MISFET_$MN_3$. When the switch 18 is OFF (see FIG. 5), the fourth current input MISFETs_$MN_{1a}$, $MN_{1b}$, and $MN_{1c}$ integrally function as a current mirror having a mirror ratio of 3. The MISFETs which constitute a current mirror have the same characteristics, such as the threshold value, and the like. The MISFETs have a W/L ratio proportional to the mirror ratio. Herein, "W" of the W/L ratio is the gate width of a MISFET, and "L" of the W/L ratio is the gate length of a MISFET.

The first variable current source 5 is formed by the first current selection circuit 3*a* and the switch transistors $SWa_1$, $SWa_2$, . . . and $SWa_{15}$ shown in FIG. 4A. The second variable current source 4 is formed by the second current selection circuit 3*b* and the switch transistors $SWb_0$, $SWb_1$, . . . and $SWb_{15}$ shown in FIG. 4A. The switch transistors $SWa_1$, $SWa_2$, . . . and $SWal_5$ and the switch transistors $SWb_0$, $SWb_1$, . . . and $SWb_{15}$ may have a small size so long as they have superior constant current characteristic. Thus, the size of these transistors may be smaller than that of the MISFETs which constitute current mirrors in the current divider circuit 1.

The operation of the current divider circuit 1 having the above structure is described below.

In the case where the grayscale level of image data is 0, 1 or 2, the first current selection circuit 3*a* selects candidate reference current Iref1 as first reference current Iref_H, and the second current selection circuit 3*b* selects candidate reference current Iref0 as second reference current Iref_L.

First reference current Iref_H of 1 μA, for example, which is input to first current input MISFET_$MP_1$, is then transmitted to first current distribution MISFET_$MP_2$ through a current mirror having a mirror ratio of 1.

On the other hand, second reference current Iref_L of 500 nA, for example, which is input to second current input MISFET_$MP_3$, is then transmitted to third current input MISFET_$MN_5$ and second MISFET_$MN_7$ through a current mirror.

Thus, an electric current corresponding to the difference between the first reference current and the second reference current (Iref_H-Iref_L) flows through fourth current input MISFETs_$MN_{1a}$, $MN_{1b}$, $MN_{1c}$. Herein, as shown in FIG. 5, in the case where the grayscale level of image data is 0, 1 or 2, the switch 18 is OFF. Thus, no current flows through fourth current input MISFET_$MN_{1d}$. As a result, in the case where the switches $SW_0$, $SW_1$ and $SW_2$ are ON, an electric current corresponding to a third of the difference between the first reference current and the second reference current, (Iref_H—Iref_L)/3, flows through each of first current source MISFET_$MN_2$, second current source MISFET_$MN_3$ and third current source MISFET_$MN_4$. In the case where the switch $SW_3$ is ON, second reference current Iref_L flows through second MISFET_$MN_7$. The switches $SW_0$ to $SW_3$ are controlled by the four least significant bits of image data.

As shown in FIG. 6, in a current divider circuit of embodiment 1, when the grayscale value is 0, only the switch $SW_3$ is ON so that the value of the electric current output from the current driver is $I_0$=Iref_L.

Then, in the case where the grayscale value is 1, the switches $SW_3$ and $SW_0$ are ON while the switches SW, and $SW_2$ are OFF. Thus, the output current results in $I_1$={Iref_L+(Iref_H−Iref_L)/3}.

Then, in the case where the grayscale value is 2, the switches $SW_3$, $SW_0$ and $SW_1$ are ON while the switch $SW_2$ is OFF. Thus, the output current results in $I_2$={Iref_L+2(Iref_H−Iref_L)/3}.

Then, the operation of the current divider circuit of embodiment 1 which is performed when the grayscale value of image data is in the range of 3 to 62 is described.

Figure 7:
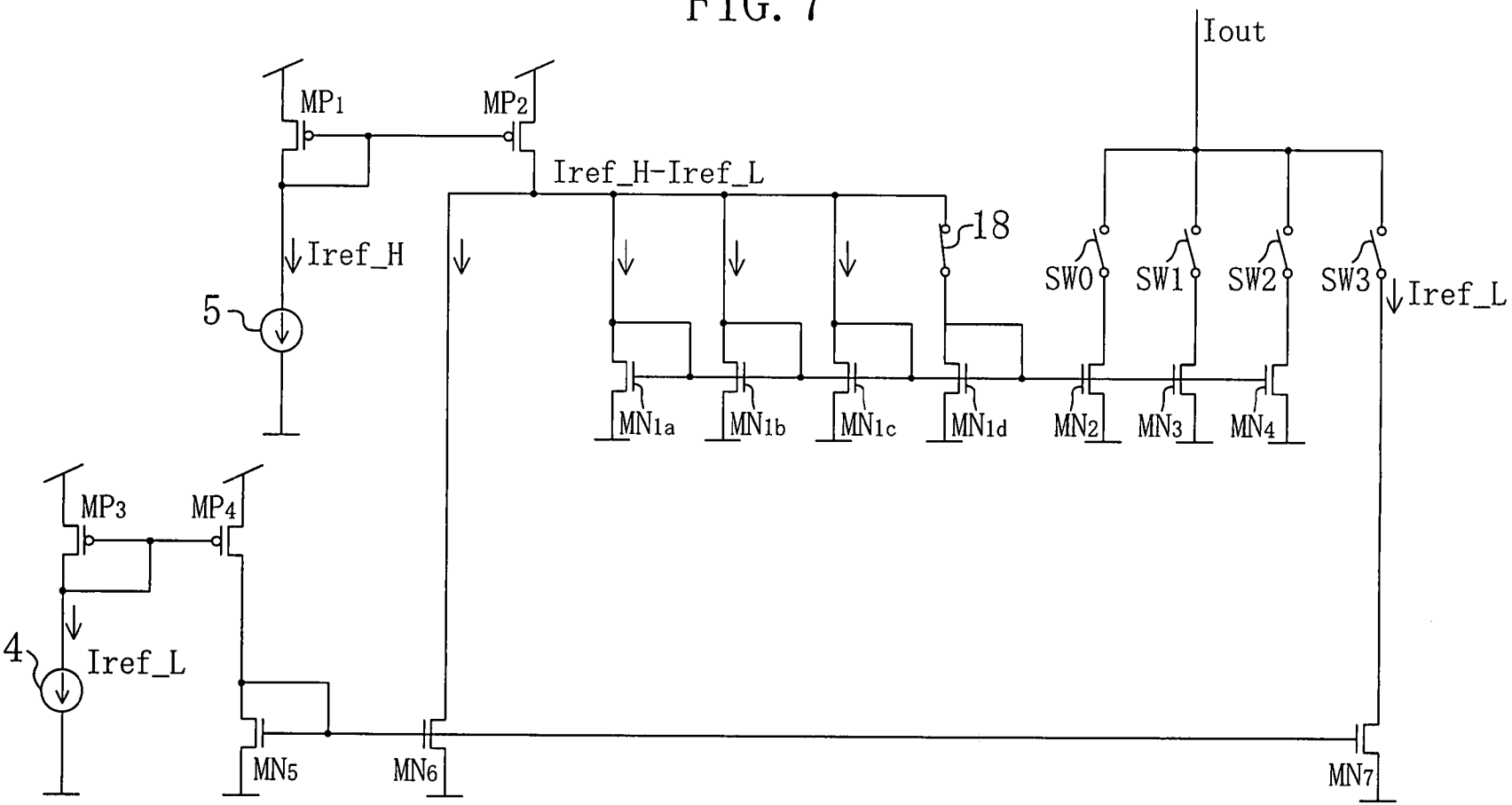
FIG. 7 is a circuit diagram showing a current divider circuit of embodiment 1, wherein the grayscale value of image data is in the range of 3 to 62.
Figure 8:
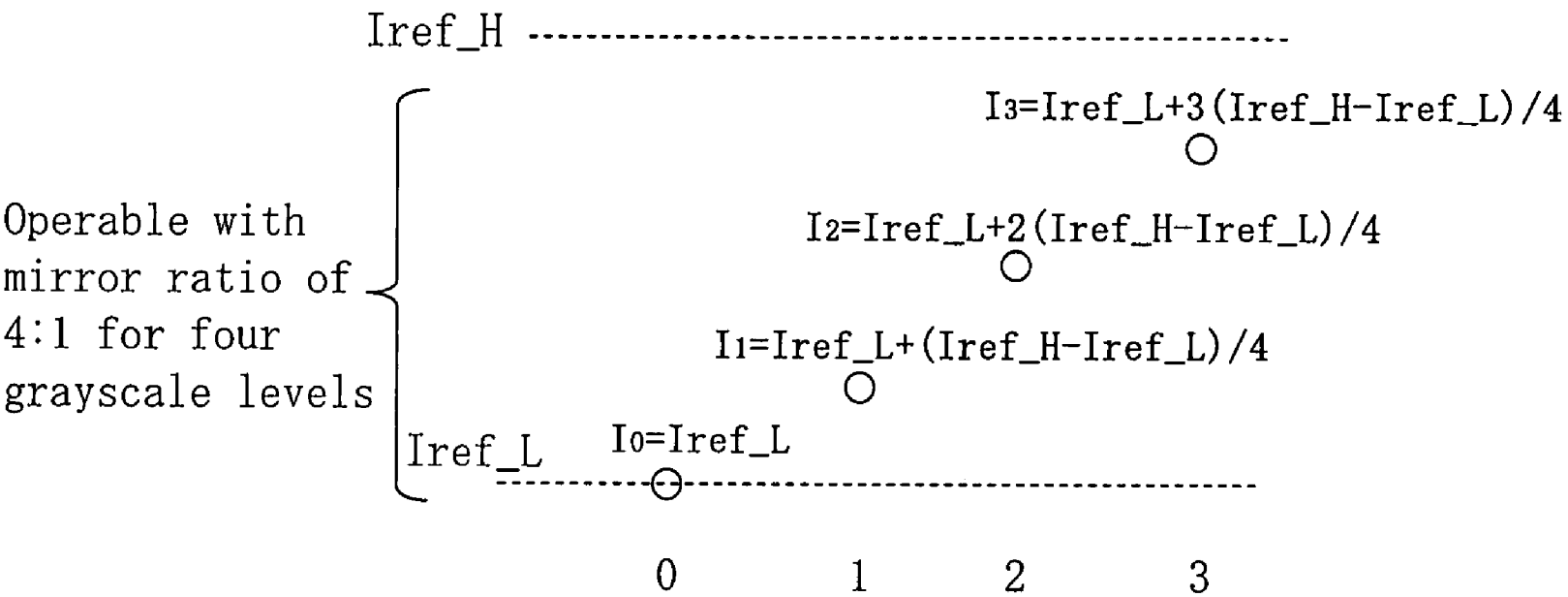
FIG. 8 illustrates an output current from the current divider circuit shown in FIG. 7.

FIG. 7 is a circuit diagram showing the current divider circuit of embodiment 1 wherein the grayscale value of image data is in the range of 3 to 62. FIG. 8 illustrates an output current from the current divider circuit shown in FIG. 7.

The current divider circuit 1 shown in FIG. 7 is the same circuit as the current divider circuit 1 shown in FIG. 5 but is different only in that the switch 18 is ON. Hereinafter, only the operation of the current divider circuit 1 is described.

In the case where the grayscale value of image data is in the range of 3 to 6, the first current selection circuit 3*a* selects candidate reference current $Iref_2$ as first reference current Iref_H, and the second current selection circuit 3*b* selects candidate reference current Iref1 as second reference current Iref_L.

First reference current Iref_H, which is input to first current input MISFET_$MP_1$, is then transmitted to first current distribution MISFET_$MP_2$ through a current mirror having a mirror ratio of 1.

On the other hand, second reference current Iref_L, which is input to second current input MISFET_$MP_3$, is then transmitted to third current input MISFET_$MN_5$ and second MISFET_$MN_7$ through current mirrors having equal mirror ratio.

Thus, an electric current corresponding to the difference between the first reference current and the second reference current (Iref_H-Iref_L) flows through fourth current input MISFETs_$MN_{1a}$, $MN_{1b}$, $MN_{1c}$, $MN_{1d}$. Thus, in the case shown in FIG. 7, fourth current input MISFETs_$MN_{1a}$, $MN_{1b}$, $MN_{1c}$, $MN_{1d}$ integrally function as a current mirror having a mirror ratio of 4. As a result, in the case where the switches $SW_0$, $SW_1$ and $SW_2$ are ON, an electric current corresponding to a fourth of the difference between the first reference current and the second reference current, (Iref_H−Iref_L)/4, flows through each of first current source MISFET_$MN_2$, second current source MISFET_$MN_3$ and third current source MISFET_$MN_4$. As shown in FIG. 7, the switches $SW^0$ to $SW_3$ are controlled by image data which is in the form of binary data. For example, in the case where the grayscale value is 3, only the switch $SW_0$ is ON. Thus, the output current results in $I_0$=Iref_L. Alternatively, in the case where the grayscale value is 4, the switches $SW_3$ and $SW_0$ are ON while the switches $SW_1$ and $SW_2$ are OFF. Thus, the output current results in $I_1$={Iref_L+(Iref_H−Iref_L)/4}. Likewise, in the case where the grayscale value is 5, the switch $SW_1$ is further turned ON. In the case where the grayscale value is 6, the switch $SW_2$ is further turned ON.

By the above operation, when the grayscale value is in the range of 3 to 6, the output current can be selected from a plurality of levels of electric currents which are different by one of equally-separated parts of the difference between first reference current Iref_H and second reference current Iref_L.

Although the operation has been described above for the case where the grayscale value is in the range of 3 to 6, substantially the same operation is performed in the case where the grayscale value is in the range of 7 to 62. It should be noted that second reference current Iref_L in a certain sub-range is first reference current Iref_H in the previous sub-range. First reference current Iref_H in a certain sub-range is second reference current Iref_L in the next sub-range.

For example, as shown in FIG. 3, in the case where the grayscale value is in the range of 7 to 10, candidate reference current Iref3 is selected as first reference current Iref_H, and candidate reference current Iref2 is selected as second reference current Iref_L. Reference currents Iref_H and Iref_L are selected in the same way in each sub-range up to the sub-range of the grayscale value from 59 to 62. The correspondence between the grayscale values of image data and the sets (combinations) of reference currents is set in advance in the first current selection circuit 3*a* and second current selection circuit 3*b*.

With the above, the intervals between the output current values are prevented from varying at the boundaries between sub-ranges. It should be noted that the "sub-range" means the minimum one of the ranges of grayscale values. In this example, the "sub-range" means each of 16 ranges of divided grayscale values. In the current driver of embodiment 1, as shown in FIG. 4, candidate-reference current Iref16 is output without being passed through the current divider circuit 1 only when the grayscale value is the maximum value, i.e., 63.

As described above, in the case where the current divider circuit 1 of embodiment 1 is used, the current divider circuit 1 can output a plurality of levels of electric currents, the magnitude of which are different by one of equally-separated parts of the difference between two reference currents input to the current divider circuit 1, by adjusting the mirror ratio of a current mirror. Thus, the first current selection circuit 3*a* and the second current selection circuit 3*b* are used to select the first and second reference currents according to the grayscale value of image data, whereby it is possible to output an electric current according to image data over the entire grayscale range using one current divider circuit 1 for one output of the current driver.

The value of a candidate reference current supplied from the outside of an LSI chip can be set to any value, and therefore, the gradient of the graph which represents the relationship between the output current value and the grayscale value can be adjusted to be different among the sub-ranges. Thus, the gamma correction can be performed so as to conform to the visual characteristics of a human, such that a user perceives an image as intended by image data. Note that, in some cases, other corrections, for example, correction to the characteristics of TFTs provided over a panel, may be performed in addition to the above correction performed in view of the visual characteristics. Even in such a case, a desirable operation can be performed by appropriately setting the interval of the values of candidate reference currents supplied from the outside of the LSI chip and the number of the candidate reference currents. Thus, for example, the manufacturer of a display device can make their own correction using the LSI chip of the current driver of embodiment 1. In the case of using the current driver of embodiment 1, contrast adjustment for the entire panel can be performed, in addition to the gamma correction, by setting the reference currents generally higher or lower. The brightness balance among R (red), G (green) and B (blue) is adjusted by adjusting the brightness of each of these colors. In organic EL elements, different light emission materials are used for the colors of R, G and B, and therefore, the current driver of embodiment 1 is preferably used.

The number of candidate reference currents and the interval of current values may be set to any value and any interval, respectively, and therefore, any correction other than the gamma correction may be performed.

Figures 13A, 13B:
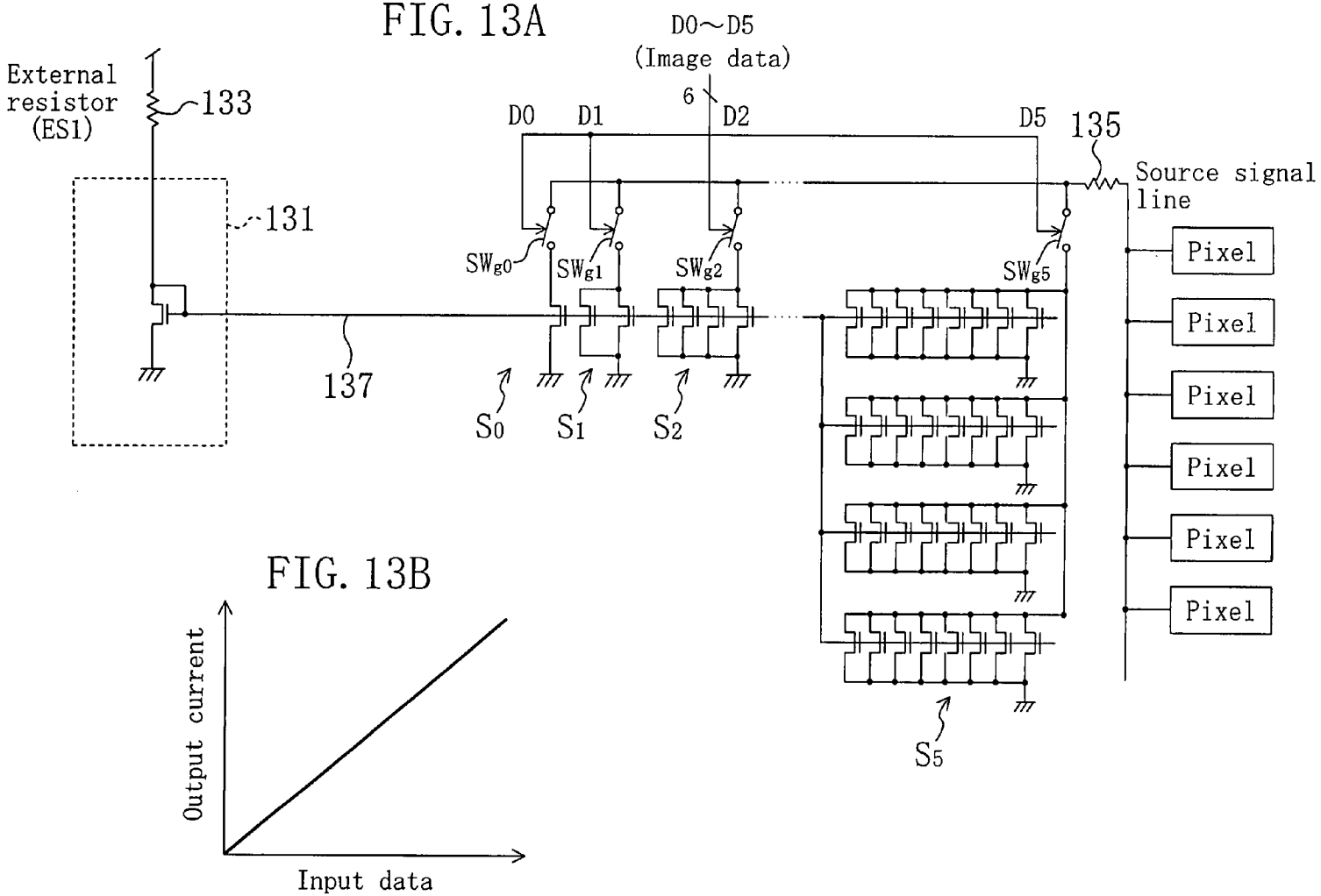
FIG. 13A is a circuit diagram showing a structure of a conventional current mode D/A converter.
FIG. 13B illustrates the relationship between image data input to the conventional current mode D/A converter and the output current of the conventional current mode D/A converter.

In the current driver of embodiment 1, the number of MISFETs included in a current divider circuit is significantly smaller than the number of MISFETs included in the conventional D/A converter of FIG. 13. Thus, the current driver of embodiment 1 has a significantly reduced circuit area, and in addition, the output current characteristic can be corrected in the current driver of embodiment 1. The switch transistors $SWa_1$, $SWa_2$, . . . and $SWa_{15}$ and the switch transistors $SWb_0$, $SWb_1$, . . . and $SWb_{15}$ are formed by MISFETs which have a size smaller than that of the MISFETs included in the current divider circuit, and therefore, the area of the switch transistors is small. The reference current source for generating the candidate reference currents may be provided outside or inside the LSI chip of the current driver. Even when the reference current source is provided inside the LSI chip, the circuit size of the LSI chip is smaller than a conventional LSI chip.

Although the example of the current driver described in embodiment 1 is for a 64-grayscale level display device, the current driver can drive a display panel having a higher gray level resolution by increasing the number of external reference current sources without making a modification to the current divider circuits shown in FIGS. 5 and 7.

Although it is necessary to provide one set of the current divider circuit 1, the first current selection circuit 3*a* and the second current selection circuit 3*b* (see FIG. 4) to one output of the current driver, the external current source for supplying candidate reference currents may be shared among a plurality of current divider circuits 1.

In the example illustrated in embodiment 1, candidate reference current Iref16 is directly output from the current driver. However, candidate reference current Iref0 may be directly output from the current driver instead. In such a case, in the current divider circuit 1, for a certain sub-range, reference current Iref_H is output in place of reference current Iref_L that is output from the current divider circuit shown in FIG. 8.

In the above description of embodiment 1, the first reference current is always larger than the second reference current. By changing the settings of the current selection circuits such that the first reference current is smaller than the second reference current, so-called negative/positive-inverted display can be performed. Thus, "negative display mode" and "positive display mode" can be set without converting image data.

In embodiment 1, first current source MISFET_$MN_2$, second current source MISFET_$MN_3$ and third current source MISFET_$MN_4$ are n-channel type MISFETs while the current distribution MISFETs are p-channel type MISFETs. However, the current divider circuit 1 normally operates even if the conductivity type of all of the MISFETs included in the current divider circuit 1, including the above MISFETs, is inverted.

The current divider circuit 1 may have a structure different from those of the circuits shown in FIGS. 5 and 7, so long as the current divider circuit 1 outputs an electric current which is equal to or higher than the first reference current and equal to or lower than the second reference current and which is determined according to a plurality of grayscale values of image data. The output current characteristic may be corrected even if output current values corresponding to the grayscale values are not equally separated.

In the description of embodiment 1, the current driver is produced in the form of an LSI chip and used in a display device. However, the current driver of embodiment 1 may be integrally formed in a substrate of a display panel.

Embodiment 2

In embodiment 2 of the present invention, a current driver which uses a voltage variable according to image data as "reference voltage" is described, although in embodiment 1 an electric current which varies according to image data is employed as a reference current.

Figure 9:
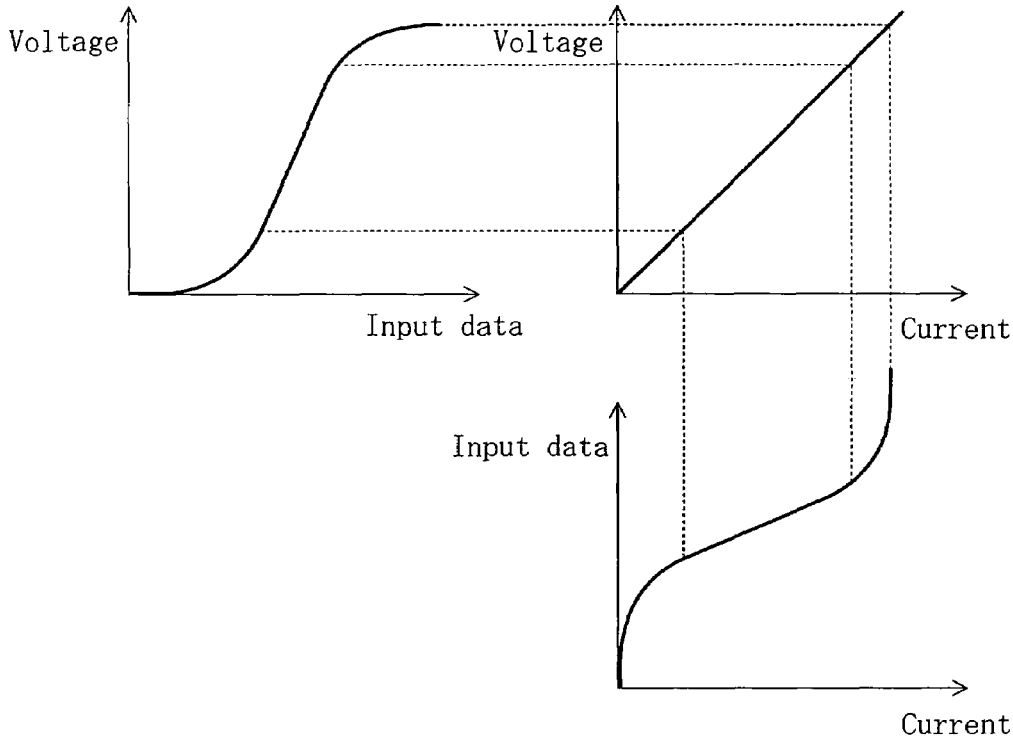
FIG. 9 illustrates the relationship between the grayscale value of input data (image data) and a corresponding output current and the relationship between the grayscale value of input data and the output voltage from a voltage selection circuit.
Figure 10:
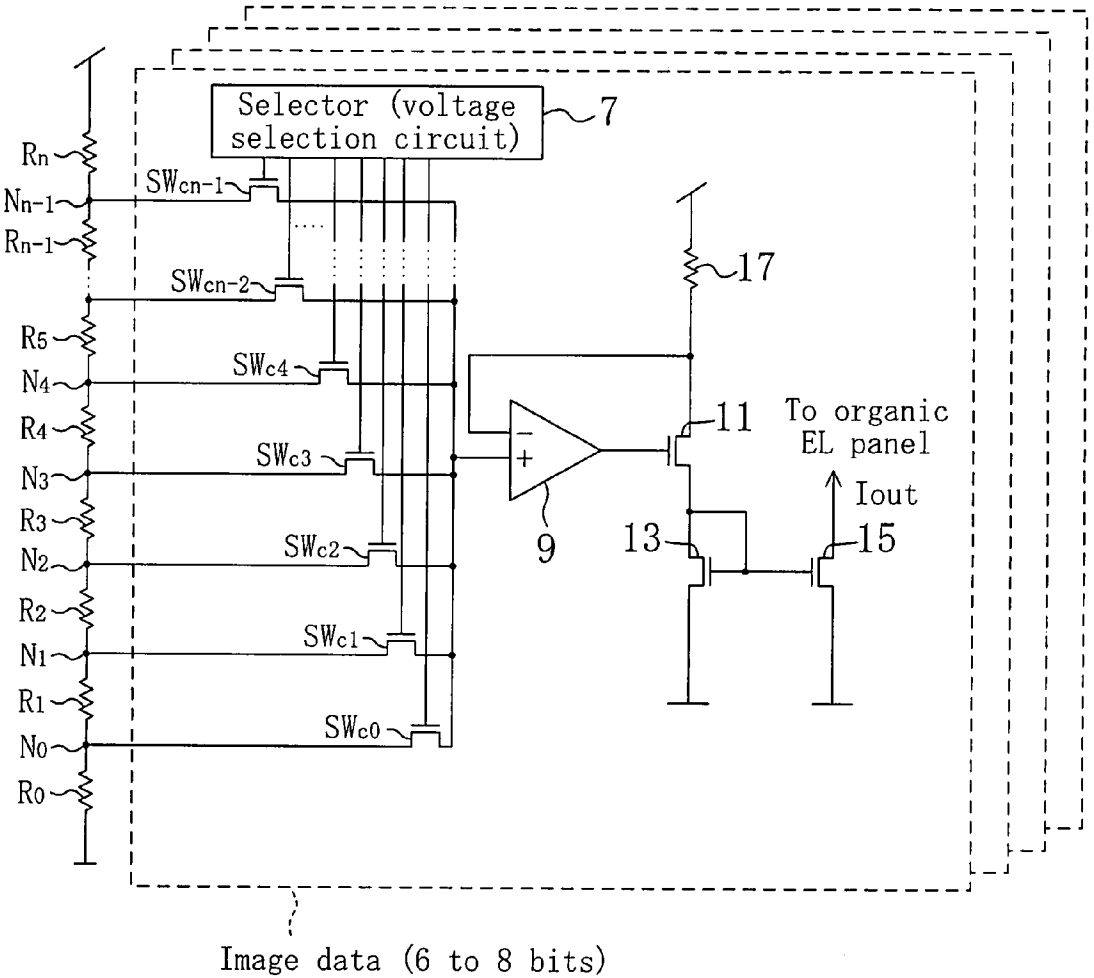
FIG. 10 is a circuit diagram showing part of a current driver according to embodiment 2.

FIG. 9 illustrates the relationship between the grayscale value of input data (image data) and the output current corresponding thereto and the relationship between the grayscale value of the input data and the output voltage from a voltage selection circuit. FIG. 10 is a circuit diagram showing part of a current driver of embodiment 2. In the current driver of embodiment 2, circuits corresponding to 528 outputs, for example, are integrated into one LSI chip. FIG. 10 shows the structure of a circuit for outputting one of the 528 outputs of the current driver.

As shown in FIG. 10, the current driver of embodiment 2 includes: (n+1) resistive elements $R_0$ to $R_n$ which are connected in series between a supply voltage supplying section and a ground (n denotes the number of grayscale levels); switches $SWc_0$, $SWc_1$, . . . and $SWc_{n-1}$ connected to nodes (voltage supplying sections) $N_0$ to $N_{n-1}$ which exist between the neighboring resistive elements $R_0$ to $R_n$; a voltage selection circuit (selector) 7 for controlling the switches $SWc_0$, $SWc_1$, . . . and $SWc_{n-1}$ such that the voltage at any one of the nodes $N_0$ to $N_{n-1}$ is output according to the image data; an operational amplifier 9 having a positive (+) input section connected to the switches $SWc_0$, $SWc_1$, . . . and $SWc_{n-1}$; a third MISFET 11 of p-channel type which has a gate electrode connected to the output terminal of the operational amplifier 9; an output resistor 17 having an end supplied with the supply voltage and the other end connected to the source of the third MISFET 11; a fourth MISFET 13 of n-charnel type which is connected to the drain of the third MISFET 11 and whose drain and gate electrode are connected to each other; and a fifth MISFET 15 of n-channel type. The fourth MISFET 13 and fifth MISFET 15 constitute a current mirror. The negative (−) input section of the operational amplifier 9 is connected to the third MISFET 11 and the output resistor 17. That is, since the operational amplifier 9 is a negative-feedback type amplifier, the operational amplifier 9 is controlled such that the voltages at the positive (+) input section and negative (−) input section are equal. The output resistor 17 can be made of polysilicon, for example, but may be subjected to trimming as necessary in order to suppress a variation in the resistance value among the outputs of the driver.

In the current driver of embodiment 2, the voltage selection circuit 7 and the operational amplifier 9 are provided for each output, but the resistive elements $R_0$ to $R_n$ can be shared among a plurality of outputs.

Part of the current driver of embodiment 2 which is shown in FIG. 10 corresponds to a D/A converter of a conventional current driver. Thus, the structure of the current driver of embodiment 2 is the same as that of embodiment 1 and that of the conventional current driver, except for the part shown in FIG. 10.

Next, the operation of the current driver of embodiment 2 is described.

In the current driver of embodiment 2, different voltages are output from the nodes (voltage supplying sections) $N_0$ to $N_{-1}$. The voltages at the nodes $N_0$ to $N_{n-1}$ have different values which correspond to the grayscale levels of 0 to (n−1). The resistive values of the resistive elements $R_0$ to $R_n$ are set such that the voltages at the nodes $N_0$ to $N_{n-1}$ form a nonlinear S-shaped graph shown in the left part of FIG. 9. That is, the resistive values of the resistive elements $R_0$ to $R_n$ are set such that the gradient of the graph which represents the voltage against the grayscale level is relatively small (moderate) in the low-grayscale level range and high-grayscale level range but relatively large (steep) in the middle-grayscale level range.

Then, the voltage selection circuit 7 selects only the voltage at any one of the nodes according to the image data and inputs the selected voltage to the positive (+) input section of the operational amplifier 9.

Then, the output of the operational amplifier 9 is applied to the gate electrode of the third MISFET 11, and an electric current having a value proportional to the output voltage of the operational amplifier 9 (see the upper right part of FIG. 9) is output from the drain of the third MISFET 11. Herein, since the source of the third MISFET 11 is connected to the negative (−) input section of the operational amplifier 9, the output voltage of the operational amplifier 9 is a voltage obtained by amplifying the voltage input to the operational amplifier 9. Since the potential at the negative (−) input section is applied to the output resistor 17, the electric current flowing through the output resistor 17 has a value obtained by dividing the voltage selected in the voltage selection circuit 7 by the resistance value of the output resistor 17, i.e., the value of (the voltage selected by the voltage selection circuit 7)/(the resistance value of the output resistor 17).

The electric current output from the drain of the third MISFET 11 is output from output terminal lout of the current driver to a panel through a current mirror. The relationship between the output current from the current driver and the grayscale value of input data is represented by a curve in the graph of lower right part of FIG. 9.

As described above, in the current driver of embodiment 2, the voltage which is output from a variable voltage source (including the voltage selection circuit 7, the resistive elements $R_0$ to $R_n$, and the switches $SWc_0$ to $SWc_{n-1}$) according to image data is converted by a voltage-current conversion circuit (including the operational amplifier 9 and the third MISFET 11) to an electric current.

In the current driver of embodiment 2, the number of nodes (voltage supplying sections) $N_0$ to $N_{n-1}$ is the same as the number of grayscale levels. The resistance values of the resistive elements $R_0$ to $R_n$ are set such that the potentials at the nodes form a nonlinear graph, whereby the output current characteristic is more approximate to the visual characteristics as compared with a conventional current driver. The potential of the node can be set to any potential for each grayscale level, and therefore, the output current can be corrected with higher resolution as compared with embodiment 1. Thus, in the case of using the current driver of embodiment 2 in a current-driven display device, a user visually perceives displayed images as intended by image data.

Among the components of the current driver of embodiment 2, the resistive elements $R_0$ to $R_n$ and the voltage selection circuit 7, except for the voltage-current conversion circuit, can be formed by circuit components used in a driver for a voltage-driven liquid crystal display device. Thus, the current driver of embodiment 2 is readily designed as compared with the current driver of embodiment 1. Even if the number of grayscale levels is increased, it is only necessary to increase the number of serially-connected resistors.

The size of the MISFETs which constitute the switches $SWc_0$ to $SWc_{n-1}$ is smaller than that of the MISFETs included in a conventional D/A converter, and therefore, the circuit area of the current driver of embodiment 2 is smaller than that of a conventional current driver, although the circuit area is slightly larger than that of the current driver of embodiment 1.

Although in the structure of FIG. 10 the electric current is routed from the panel side to the current driver side, the electric current is supplied from the third MISFET 11 directly to the panel in a structure where the electric current is routed from the current driver to the panel side.

In the example described above, the variable voltage source includes serially-connected resistors, a voltage selection circuit and switches. However, according to the present invention, the components of the variable voltage source are not limited to any particular components so long as the voltage is output at different levels according to the grayscale value of image data. Furthermore, the components of the voltage-current conversion circuit are not limited to the example shown in FIG. 10.

Variation of Embodiment 2

Figure 11:
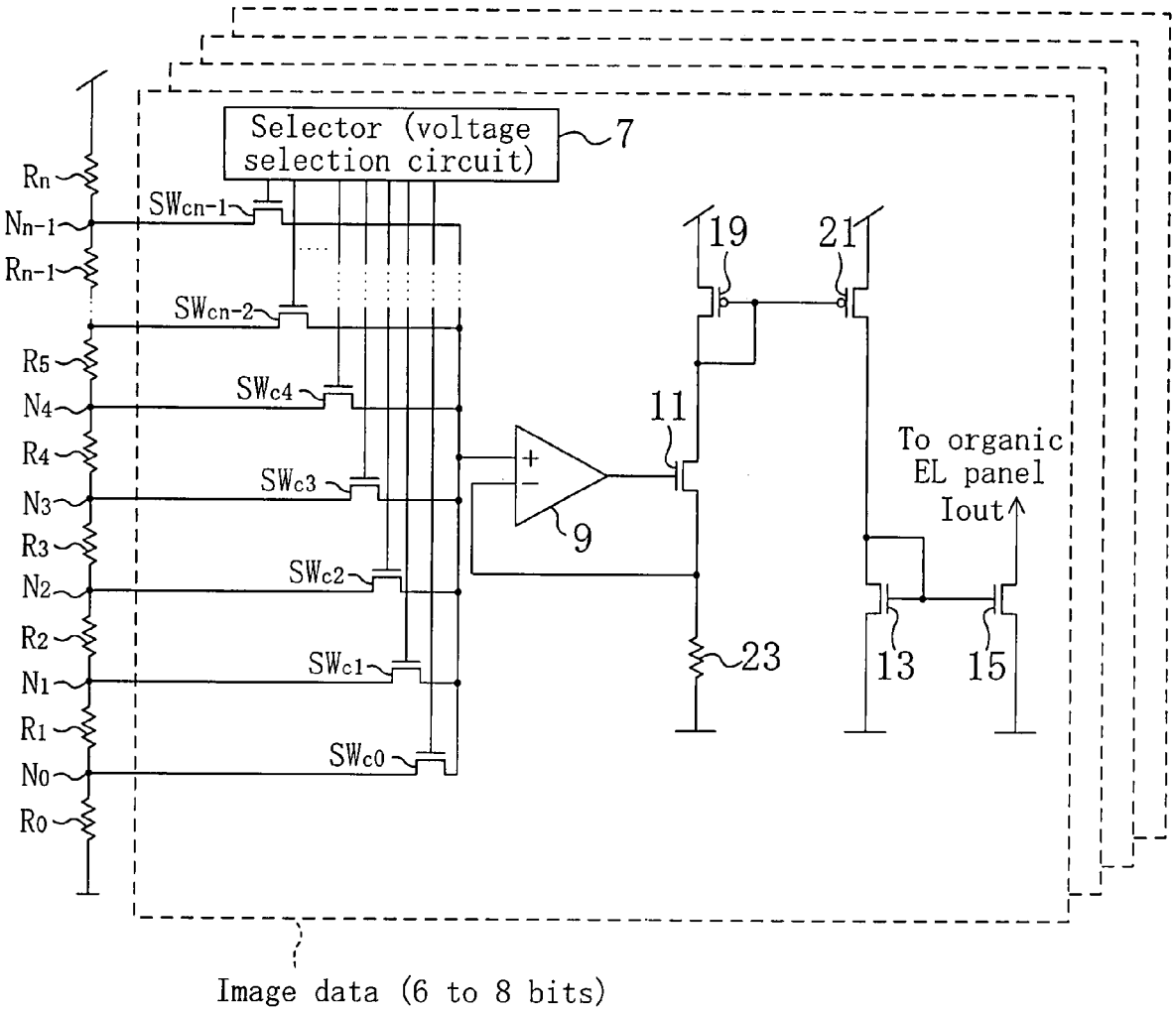
FIG. 11 is a circuit diagram showing a variation of the current driver of embodiment 2.

FIG. 11 is a circuit diagram showing a variation of the current driver of embodiment 2.

The variation described herein is different from the above-described structure of embodiment 2 in that the conductivity type of the third MISFET 11 which receives the output of the operational amplifier 9 at the gate electrode is changed to n-channel type. Thus, the voltage selection circuit 7, the resistive elements $R_0$ to $R_n$ and the switches $SWc_0$ to $SWc_{n-1}$ are the same as those of the above-described current driver of embodiment 2. Hereinafter, only the differences from the above-described current driver of embodiment 2 are described.

The current driver of the variation of embodiment 2 includes: an output resistor 23; a sixth MISFET 19 of p-channel type; a seventh MISFET 21 of p-channel type; a fourth MISFET 13 of n-channel type which is connected to the seventh MISFET 21; and a fifth MISFET 15 of n-channel type. One end of the output resistor 23 is connected to the source of the third MISFET 11, and the other end is connected to the ground. The drain of the sixth MISFET 19 is connected to the drain of the third MISFET 11, and the drain and gate electrode of the sixth MISFET 19 are connected to each other. The sixth MISFET 19 and the seventh MISFET 21 constitute a current mirror. The fourth MISFET 13 and the fifth MISFET 15 constitute another current mirror.

In the structure of the current driver of this variation, the electric current output from the third MISFET 11 is transmitted to the fourth MISFET 13 by a current mirror formed by the sixth MISFET 19 and the seventh MISFET 21, whereby the electric current is output from the fifth MISFET 15 of n-channel type (i.e., electric charges are introduced from the panel).

Even with the above structure of this variation, the circuit area is reduced as compared with a conventional one, and it is possible to adjust the output current characteristic to the visual characteristics.

As described above, the output current characteristic is corrected regardless of the conductivity type of the third MISFET 11 which performs voltage-current conversion.

What is claimed is:

1. A current driver to which image data including a plurality of grayscale values is input and which outputs an electric current according to the grayscale values of the image data, the current driver comprising a current divider circuit that includes:

a first input section to which a first reference current is input, a current value of the first reference current being changed according to the grayscale values of the image data;

a second input section to which a second reference current is input, the second reference current having a current value different from that of the first reference current, and wherein the current divider circuit which uses the first reference current and the second reference current to output an electric current, the electric current having a value equal to or higher than that of the second reference current and equal to or lower than that of the first reference current.

2. The current driver of claim 1, wherein the current divider circuit calculates a division value obtained by dividing the difference in the current value between the first reference current and the second reference current into equal parts and outputs electric currents equally separated by the division value according to the grayscale values of the image data.

3. The current driver of claim 1, wherein the first reference current is always larger than the second reference current.

4. The current driver of claim 1, further comprising:

a first variable current source for supplying the first reference current to the first input section according to the grayscale values of the image data; and a second variable current source for supplying the second reference current to the second input section according to the grayscale values of the image data.

5. The current driver of claim 4, wherein:

the first variable current source includes a plurality of first switches for respectively conducting a plurality of candidate reference currents, the first switches being commonly connected to the first input section, and a first current selection circuit for controlling the first switches to select any one of the plurality of candidate reference currents as the first reference current; and the second variable current source includes a plurality of second switches for respectively conducting the plurality of candidate reference currents, the second switches being commonly connected to the second input section, and a second current selection circuit for controlling the second switches to select any one of the plurality of candidate reference currents as the second reference current.

6. The current driver of claim 4, wherein the current divider circuit is a D/A converter.

7. The current driver of claim 6, wherein the current divider circuit includes:

a first current input MISFET of first conductivity type which is connected to the first variable current source, the gate electrode and drain of the first current input MISFET being connected to each other;

a first current distribution MISFET of first conductivity type, the first current distribution MISFET and the first current input MISFET constituting a current mirror;

a second current input MISFET of first conductivity type which is connected to the second variable current source, the gate electrode and drain of the second current input MISFET being connected to each other;

a second current distribution MISFET of first conductivity type, the second current distribution MISFET and the second current input MISFET constituting a current mirror;

a third current input MISFET of second conductivity type which is connected to the drain of the second current distribution MISFET, the gate electrode and drain of the third current input MISFET being connected to each other;

a fourth current input MISFET of second conductivity type which is connected to the drain of the first current distribution MISFET, the gate electrode and drain of the fourth current input MISFET being connected to each other;

a first MISFET having a drain which is connected to the drain of the first current distribution MISFET and a source of the fourth current input MISFET, the first MISFET and the third current input MISFET constituting a current mirror having a mirror ratio of 1;

a plurality of current source MISFETs, the current source MISFETs and the fourth current input MISFET constituting current mirrors, the mirror ratio of each current source MISFET to the fourth current input MISFET being 1/m where m is a natural number equal to or greater than 2.

8. The current driver of claim 1, wherein:

the grayscale values of the image data are included in any of a low grayscale range, a middle grayscale range, and a high grayscale range; and the difference in the current value between the first reference current and the second reference current which is obtained when the grayscale value of the image data is in the low grayscale range or the high grayscale range is smaller than the difference in the current value between the first reference current and the second reference current which is obtained when the grayscale value of the image data is in the middle grayscale range.

9. The current driver of claim 1, wherein the current driver includes a plurality of current divider circuits which are in the form of an integrated circuit.

* * * * *